US005601003A

United States Patent [19]

Amtenbrink et al.

[11] Patent Number: 5,601,003

[45] Date of Patent: Feb. 11, 1997

[54] HANDLE FOR TOOLS, PARTICULARLY SCREWDRIVERS

[75] Inventors: Klaus Amtenbrink, Wuppertal; Robert Hoy, Velbert; Martin Strauch, Wuppertal, all of Germany

[73] Assignee: Wera Werk Hermann Werner GmbH & Co., Wuppertal, Germany

[21] Appl. No.: 351,459

[22] PCT Filed: Jun. 8, 1993

[86] PCT No.: PCT/EP93/01442

§ 371 Date: Dec. 12, 1994

§ 102(e) Date: Dec. 12, 1994

[87] PCT Pub. No.: WO93/25354

PCT Pub. Date: Dec. 23, 1993

[30] Foreign Application Priority Data

Jun. 12, 1992 [DE] Germany ..... 42 19 253.6

[51] Int. Cl.[6] ..... B25G 1/00

[52] U.S. Cl. ..... 81/489; 81/177.1

[58] Field of Search ..... 81/489, 177.1, 81/900; 16/110 R, 116 R

[56] References Cited

U.S. PATENT DOCUMENTS

| | | | |
|---|---|---|---|
| 2,985,209 | 5/1961 | Novelo . | |
| 3,189,069 | 6/1965 | Stowell | 81/177.1 |
| 3,592,247 | 7/1971 | Solf | 81/177.1 |
| 4,290,465 | 9/1981 | Fee et al. . | |

FOREIGN PATENT DOCUMENTS

| | | | |
|---|---|---|---|
| 0208942 | 1/1987 | European Pat. Off. . | |
| 2635998 | 3/1990 | France | 81/177.1 |
| 1298060 | 6/1969 | Germany . | |
| 2204755 | 8/1973 | Germany . | |
| 3525163 | 1/1987 | Germany . | |

*Primary Examiner*—Bruce M. Kisliuk
*Assistant Examiner*—Joni B. Danganan
*Attorney, Agent, or Firm*—Martin A. Farber

[57] ABSTRACT

An injection-molded plastic handle for tools, particularly screwdrivers, having zones of plastic of different hardness, the harder plastic being nondeformable under the forces which occur as a result of the actuating load while the softer plastic permits slight elastic deformations, and having a centrally located receiving hollow space (5) for the tang of a tool blade (2), and, in order to obtain a development which is of optimized grippability and more advantageous in use, the central hollow space is located in a center part (6) having a profiled cover surface (11) around which a cover is injected, the depressions (8) resulting from the profiling of the cover surface (11) being filled with a softer plastic until obtaining an approximately circular cross-sectional shape.

20 Claims, 10 Drawing Sheets

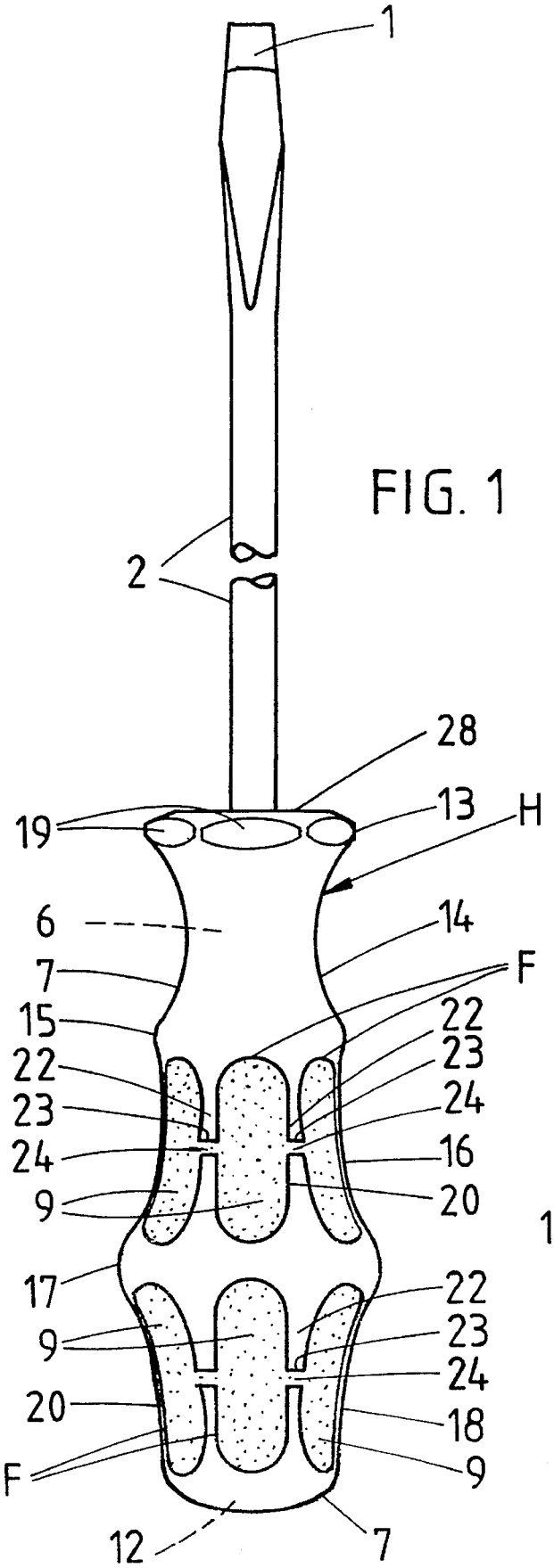
FIG. 1
FIG. 2
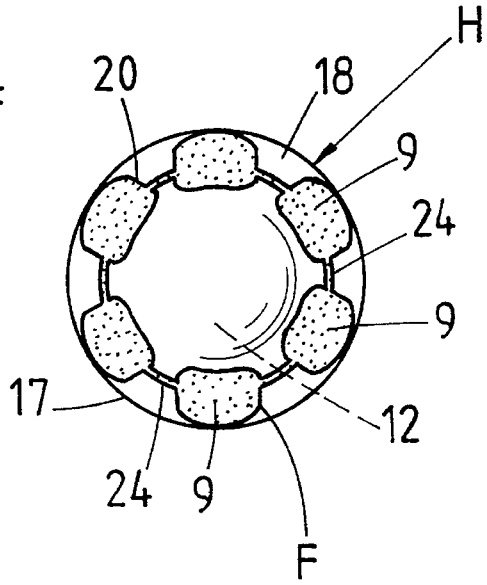

HANDLE FOR TOOLS, PARTICULARLY SCREWDRIVERS

FIELD AND BACKGROUND OF THE INVENTION

The present invention refers to an extruded plastic handle for tools, particularly screwdrivers, having regions of plastics of different hardness, the harder plastic being nondeformable under the forces occurring as the result of the actuating load and the softer plastic, however, permitting slight elastic deformations, and having a central receiving hollow space for the tang or the fastening end of a tool blade.

A handle of this type is known from Federal Republic of Germany Patent 35 25 163. Such compositions of material result, with uniform circumferential distribution, in improved grippability of the handle. While having a stable base body, a grip in the hand of the worker which avoids pressure points is obtained.

In handles with areas of plastics of different hardness there is furthermore the problem of holding the tang of the tool to be inserted in the handle with the necessary stability. For instance, in the case of a screwdriver, the tang must not turn in the handle. In known screwdrivers, therefore, the region of the handle which surrounds the tang is formed of material of harder plastic. The elasticity of this hard material, to be sure, permits subsequent insertion of screwdriver blades in the handle to a limited extent. Ordinarily, such screwdriver blades which are subsequently inserted into the finished handle can also easily be removed again. The hard material as a rule is not adapted to exert the necessary holding force on, for instance the stampings present on the tang for the transmission of torque. On the other hand, if a screwdriver blade were inserted into a handle in which the receiving hollow space is surrounded by an elastic and therefore softer plastic material, while a better anchoring against the pulling-out of the blade could be obtained thereby, but deformations caused by actuation might lead to a loosening of the connection between the tang and the handle.

SUMMARY OF THE INVENTION

Recognizing this, the present invention has set itself the object of so developing a handle of this type in a manner which is advantageous for manufacture that, with optimal cohesion of the zones, the elasticity of the handle is increased and, in particular, a high degree of compensation of the deformations caused by actuation is obtained.

As a result of the development of the invention a handle of this type which is of increased stability in use is obtained. If, for instance, the center part is developed with a profiled outer surface and made of a harder material, then this center part can receive the tang of a tool, for instance a screwdriver blade. Fins or the like on the screwdriver blade which are intended to impart torque to the tool then no longer lie in the soft plastic material, but in the hard plastic material. By means of the cross-sectional profiling of the center part, which is preferably profiled in the form of a gear wheel or in star shape, a torque can be transmitted to the blade from a soft material which surrounds the hard center part without producing a loosening of the attachment between the tang and the handle. With this development, the elastic holding forces which secure the tang against being pulled out of the center part are not applied by the hard plastic material but can be applied by the softer material surrounding the hard plastic material. The action of the elasticity of the softer region can in this connection be transmitted to the tang via a substantially inelastic displacement of regions of the center part. From a manufacturing standpoint the possibility exists of producing the center part with intended break points extending parallel to the axis of the hollow space which are broken upon the driving-in of the tang. In this way, there are then produced partial regions of hard material extending parallel to the axis of the tang which are separated by a slit or the like, which regions clamp between them the region of the tang which is inserted into the handle. The force between the center regions separated by the slit or the like is exerted by the elastic plastic material which surrounds the center. The hard center part forms a dome which extends over the end of the hollow space, in which way axial displacement of the tang is also prevented if, for instance, the handle is used together with a screwdriver and the screwdriver is acted on by a blow or the like by means of a hammer. The center part preferably has a plurality of radial points of intended breakage arranged in uniform circumferential distribution. These intended places of breakage are formed in the manner that webs are formed by extrusion between cover surface and inner surface of the hollow space, they then breaking off upon the driving-in of the tang. In this connection, fins can be provided on the tang which extend radially from the preferably rectangular or round body of the tang and enter into the slit formed by the broken place of intended breakage, and thus come to lie between two parts of the center part. Due to the elastic impacting of the parts of the hook center zone which are formed upon the driving-in of the tang, the slit is pressed together again after the passage of the fins, so that the tang can be pulled out of the handle only by high pulling force. The cover surrounding the hard center part consists preferably of polyethylene or polypropylene and need not, although it can be, covered by a sleeve of preferably harder material. If the cover surrounding the cross-sectionally profiled center part is not covered by further plastic, then the outer contour of the wall is preferably made of round cross section and with its surface forms the surface of attack for the hand of the user. In particular, if this elastic cover is further covered by a sleeve which consists of a harder plastic this wall can consist of a plastic foam. It is preferable to use a light material as plastic foam so that the screwdriver can float. Another further development of the invention provides that the center part is made of a soft material and is covered by a harder cover region. For this purpose, the central hollow space is contained in a core part having a profiled outer surface which is covered by a covering of approximately constant wall thickness of harder plastic, the depressions resulting from the profiling of the outer surface being filled with a softer plastic until obtaining an approximately circular cross section. The corresponding profiling results in an intimate slip-proof attachment between the plastics of different hardness. The center part is now covered in circumferential direction, in an alternation of valleys and crests, by the layer of harder material. Its crevices are then filled up. Thus, there is a form-locked engagement of profiled section into profiled section. The corresponding undulated shape also permits a larger contact surface between the plastics connected to each other. Since the center part is surrounded by a relatively harder plastic, the center part itself can be considerably softer than it, which at the same time provides the advantage that the elasticity or flexibility of the handle continues up into the inside thereof, and therefore there is a large mass to compensate for forceful deformations. The outer wall acts in this connection as an elastic or limitedly flexible tire. All of this leads to a shape which is even more favorable for gripping, particularly as, with the advantageous utilization of the depressions present due to the constant wall thickness for the filling of the softer plastic, the customary habits of use in this connection are fully retained, only that the uniformly distributed soft places can now be produced more favorably from a manufacturing standpoint. The handle lies well in one's hand. A balanced, uniformly distributed and thus optimal mechanical connection with respect to the forces occurring on and in the handle is obtained by simple means if the cross section of the center part is imparted the profile of, for instance, a gear wheel. To this extent, there are obtained grooves which are oriented in the longitudinal direction of the handle result in uniform arrangement and at a precise angle apart. On the one hand, for considerations of molding (one point of feed is sufficient on each side of the joint) and, on the other hand, in order to obtain a depth-exceeding connection of the fillings, it is furthermore proposed that the individual fields of the filled depressions which lie one behind the other in circumferential direction be connected in each case by a rib of softer plastic material which extends in circumferential direction and fills a groove in the cover. The fillings thus "fit the hand". Furthermore, the grooves act as distributing channels for the injection molding compound. It is furthermore advantageous for the groove to extend in depth up to or into the center part. In this way, even with penetration of the relatively hard cover, a radially directed anchoring of the fillings on or in the center part can be produced. In addition to an interlacing with the shell, this represents a connection which, as a whole, excellently withstands high mechanical stresses. Finally, it is also or even independent importance that the center part consists of porously injected recycling material. What is in mind here is primarily also again plastic so that in this way an environmental-friendly measure is obtained, namely the use of "scrap material". The composition which forms the center part has in this connection by far the greater proportion of material, this center part being surrounded in stabilizing manner by the hard new plastic composition in the manner of a backing layer of clearly smaller proportion of material. The center part extends in a pocket. The porosity can be increased up to floatability of the handle (plus blade). The central hollow space is generally formed around the tang, or the tang is inserted into such a hollow space. In the latter case, the rotation-preventing means are developed in the manner of a knife edge (knife-edge tang). It is furthermore provided that in the case of a handle such as last described, the region described there as rich center part and which preferably consists of a recycling material, again has a hard inner center part which then has the good torque-transmitting properties mentioned at the start and is adapted, in particular, for providing the handle subsequently with tools (blades).

BRIEF DESCRIPTION OF THE DRAWINGS

The object of the invention is described in further detail below with reference to an embodiments shown in the drawings, in which:

FIG. 1 is a side view of a screwdriver having the handle in accordance with the invention;

FIG. 2 is a bottom view of the handle, looking at the end of the screwdriver facing away from the blade;

DETAILED DESCRIPTION OF THE PREFERRED EMBODIMENTS

Figure 4:
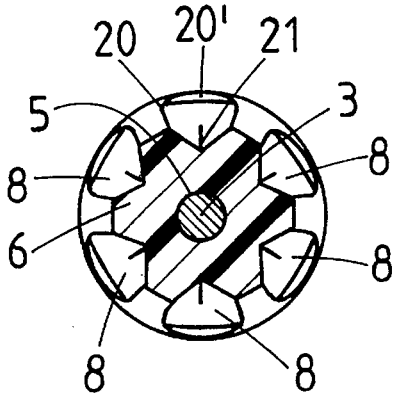
FIG. 4 is a section along the line IV—IV of FIG. 3.
Figure 6:
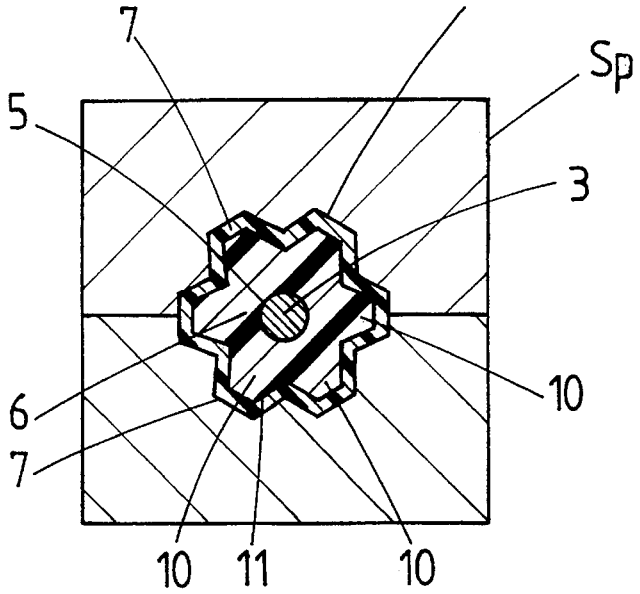
FIG. 6 is a cross section thereof, along the line VI—VI of FIG. 5.

The screwdriver shown in FIG. 1 is provided with a handle H.

The handle H is seated on the end 3 facing away from the end bearing a knife edge 1 of the screwdriver blade 2. The end 3 has rotation-preventing knife edges or fins 4.

In the case of other tools, for instance a file, the end 3 would be the tang.

Said end 3 extends a greater or lesser length within a central lengthwise hollow space 5 in the handle H.

The screwdriver blade 2 consists of steel.

The handle H consists of plastic, divided into zones of different harshness.

A first zone is formed by a center part 6. The latter constitutes the largest proportional accumulation of material and is viscoelastic.

A second zone forms a cover 7 surrounding the center part 6. The cover consists of hard plastic.

Another, and thus third or last zone, results from fillings 9 introduced in depressions 8 of the cover 7. These fillings in this case are plastic which is deformable under the actuating loads which occur, which falls within the soft-elastic category.

The three said components result in a grip-compatible handle H by means of which a high torque can be applied, without resulting in painful pressure points on the actuating hand.

On the other hand, however, the holding together of the zones is assured, not only as a result of the interlacing of the individual plastic zones with each other, but also influenced essentially by a special type of profiling. This can be noted in detail from the sectional views indicated above. Thus, the center part 6, seen in cross section, has a gear-like profile. Its toothlike projections 10 are of trapezoidal shape and leave between each other, seen in cross section, the aforementioned depressions 8 in the form of V-shaped notch valleys. Projections 10 and depressions 8 lie at the same angular distance apart and create a rather large surrounding cover surface 11. A total of six projection are produced with a corresponding number of depressions 8, which are interrupted in longitudinal direction (see FIG. 8). For example as shown in the lateral cross-sectional view of FIG. 4, the projections 10 and depressions 8, viewed in circumferential direction, extend over approximately equal angles. The length of the flank of the trapezoidal projections 10 corresponds to the head flattening of the projections; the width of the head thereof is about half the size of the base of the trapezoids. The cover 7, which is internested with the cover surface 11, follows the circumferential crest/valley undulation. The cover 7 of harder plastic which is applied by injection molding maintains its wall thickness approximately constant. It is about 2 mm. The depressions 8 are evident through it and are indicated by 8 also on the coated product.

The outer surface 11 passes at one end into a slightly curved dome 12. The latter forms the end of the center part 6 facing away from the knife edge 1 and is also covered by the said cover 7 of harder plastic and, accordingly, bears the reference numeral 7.

At the end opposite the dome 12, at which the entrance to the hollow space 5 is present, the cover formed of harder material is drawn or creating of a collar 13. The collar 13 stands out clearly with respect to an annular throat 14 of the handle H which lies in front of it. Said annular throat 14 extends over a good third of the length of the handle H and adjoins, behind a collar-like widening 15, a second annular throat 16 of approximately the same axial length as 14. Said second annular throat 16 continues rising into a gripping zone 17 of the largest diameter of the handle H in order then, descending in the same manner, to pass into a third annular throat 18 which passes via a convexly rounded end zone into the said dome 12.

The curvature of the annular throats 14, 16 and 18 is shown somewhat exaggerated. The ergonomically favorable shape of the handle, such as can be noted from the Federal Republic of Germany Patent 12 98 060, corresponding to U.S. Pat. No. 3,592,247 which is fully incorporated by reference herein, is taken as basis.

The collar 13 reaches approximately the diameter of the collar-shaped widening 15 and is non-oval and particularly hexagonal on its periphery, so that the tool does not roll away. The flats are designated 19 and can be noted from FIG. 1.

Both in the cross-sectional region of the collar-shaped broadening 15 and also in that of the gripping zone 17 of maximum diameter and of the dome 12, the profiling is interrupted in favor of an undisturbed continuous circular cross section. Gripping zone 17 and collar-shaped broadening 15 are furthermore curved convexly in the longitudinal direction of the handle. Here, therefore, a portion of harder gripping zone which extends with rotational symmetry "comes to light". In order to provide the circular cross-sectional shape also with respect to the richly profiled zones and furthermore improve the gripping of the handle H, the depressions 8 are filled with the further plastic until obtaining an approximately circular cross section. Reference is had to the cross-sectional drawings. Of course, a completely circular cross-sectional shape need not be present here. A sequence of polygonal surfaces adjoining each other in circumferential direction could also be present, this also in the manner that the depressions 8 form so-called individual fillets into which the tissue of the hand of the operator can easily fit with yielding of the filling 9.

Figure 3:
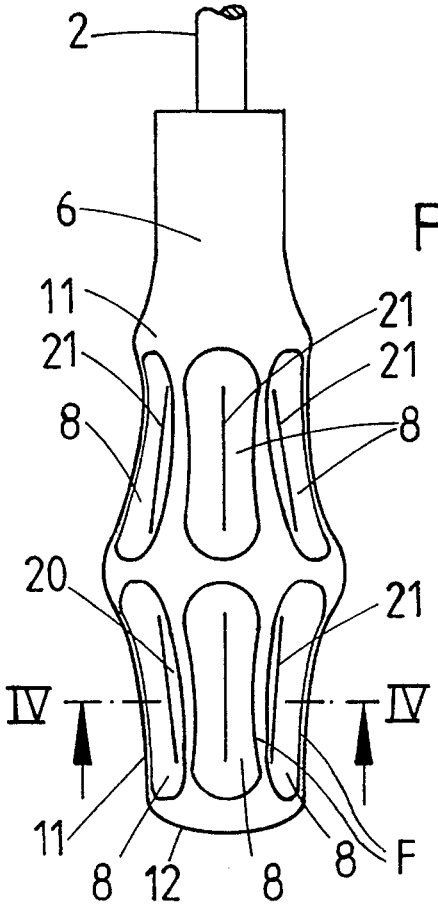
FIG. 3 shows the center part of the screwdriver in side view.
Figure 5:
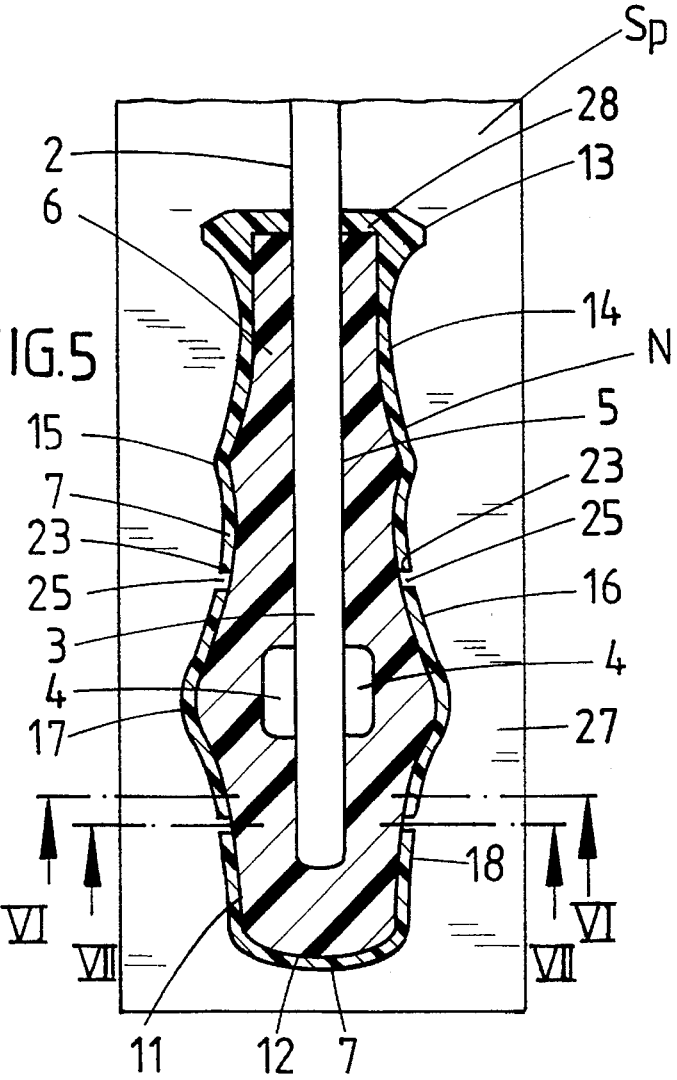
FIG. 5 shows the center part introduced into an injection mold with cover of harder plastic injected around it.

As can be noted from FIG. 3 as intermediate product, the development of depressions 8 limited to the axial length of the second and third annular throats 16, 18 leads to fields F of approximately oval contour which are distributed around the circumference. The limitation of the fields F is formed by a cover-wall-side edge 20 of the depressions 8. Their base is the knife-like groove of the V-valleys and ends at a radial distance in front of the rounded ends of the elongated fields F.

Figure 8:
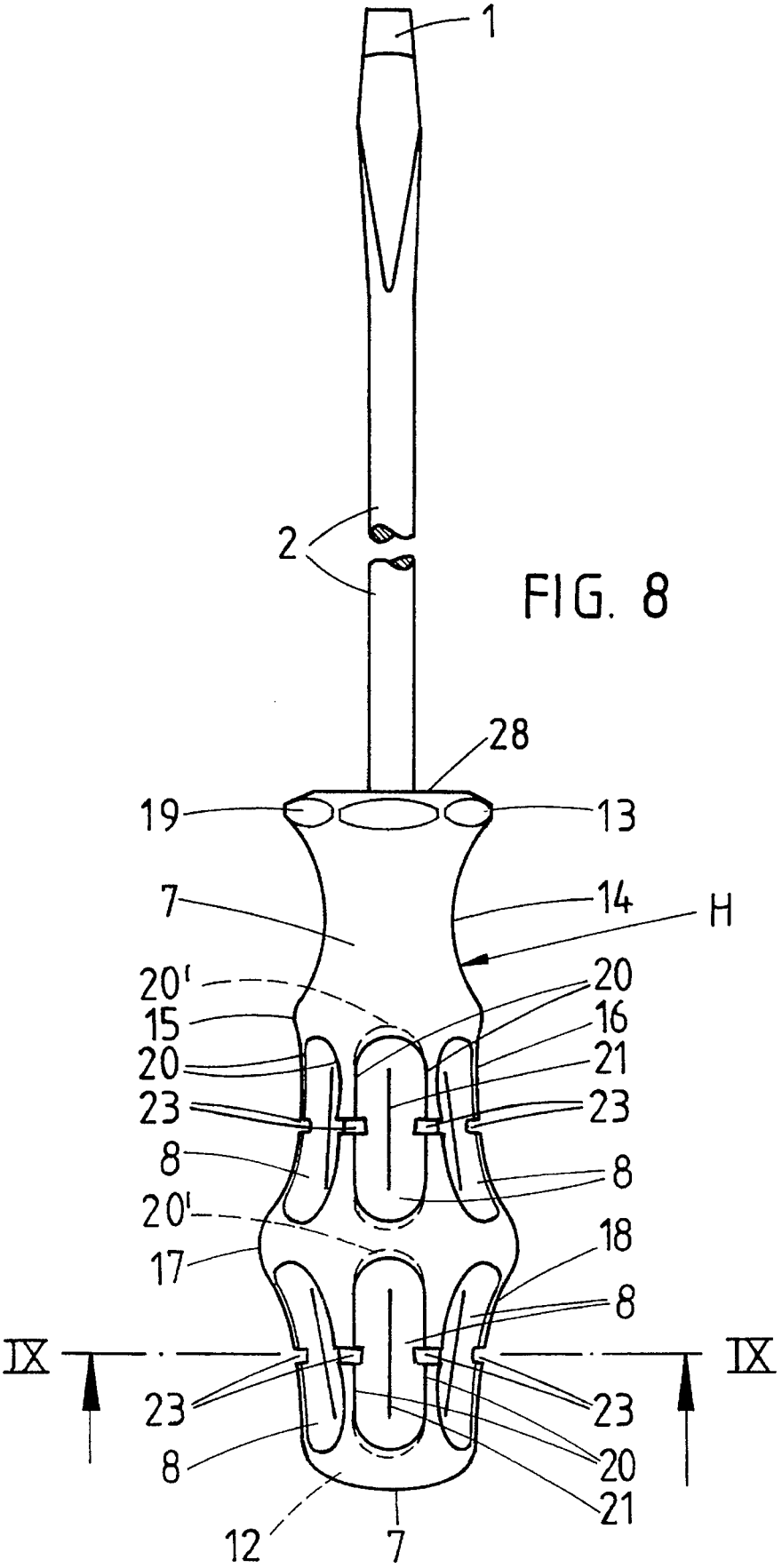
FIG. 8 shows the intermediate screwdriver product removed from the injection mold and therefore before the filling of the depressions with a softer plastic, the grooves being shown.

For an attachment between cover 7 and center part 6 which goes beyond the internesting, the edge 20 could also be undercut. This is effected at the rounded ends of the fields F and is shown in FIG. 8; see reference numeral 20'.

In the circumferential direction, the width of the fields F are 2 to 3 times the spacing between the fields (on the surface). The fields F are longitudinally oriented and the circumferential spacing between the fields forms webs 22 between adjacent fields.

As can be noted from FIG. 1, the individual fields F are integrally connected via the webs 22 of the fields F. This is achieved in the manner that the individual fields F of the filled depressions 8, the fields lying alongside of each other and one behind the other in longitudinal direction are connected in each case by a circumferentially extending groove 23. In this way, there is produced a circumferential injection connection for the fillings 9. The plastic material passing through the groove 23 is indicated there as filling rib 24.

The ribs 24 lie at the mid-length of the fields F, namely circumferentially in a common plane.

Figure 11:
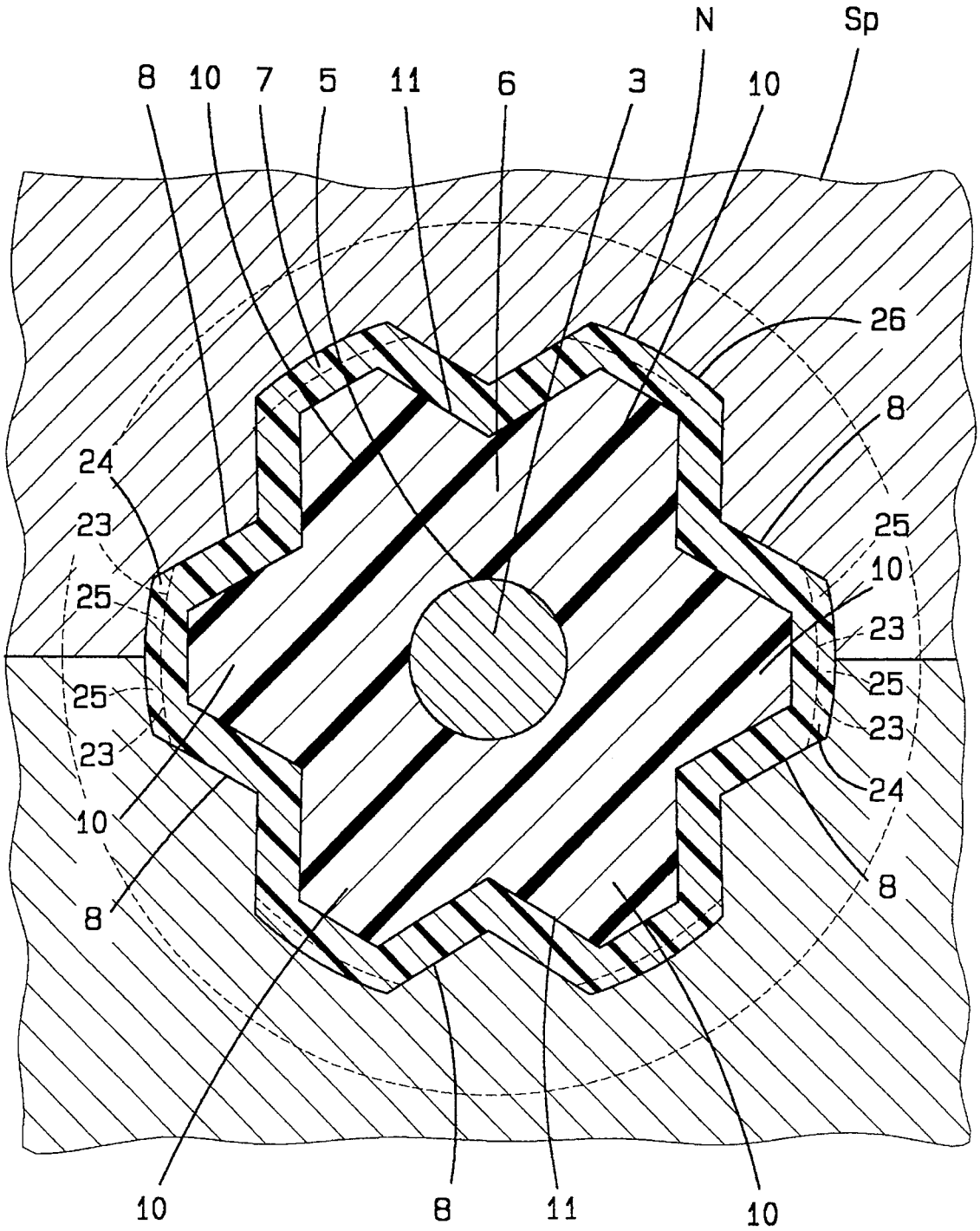
FIG. 11 is a showing of a variant comparable to the section shown in FIG. 7, with application of the cover.
Figure 12:
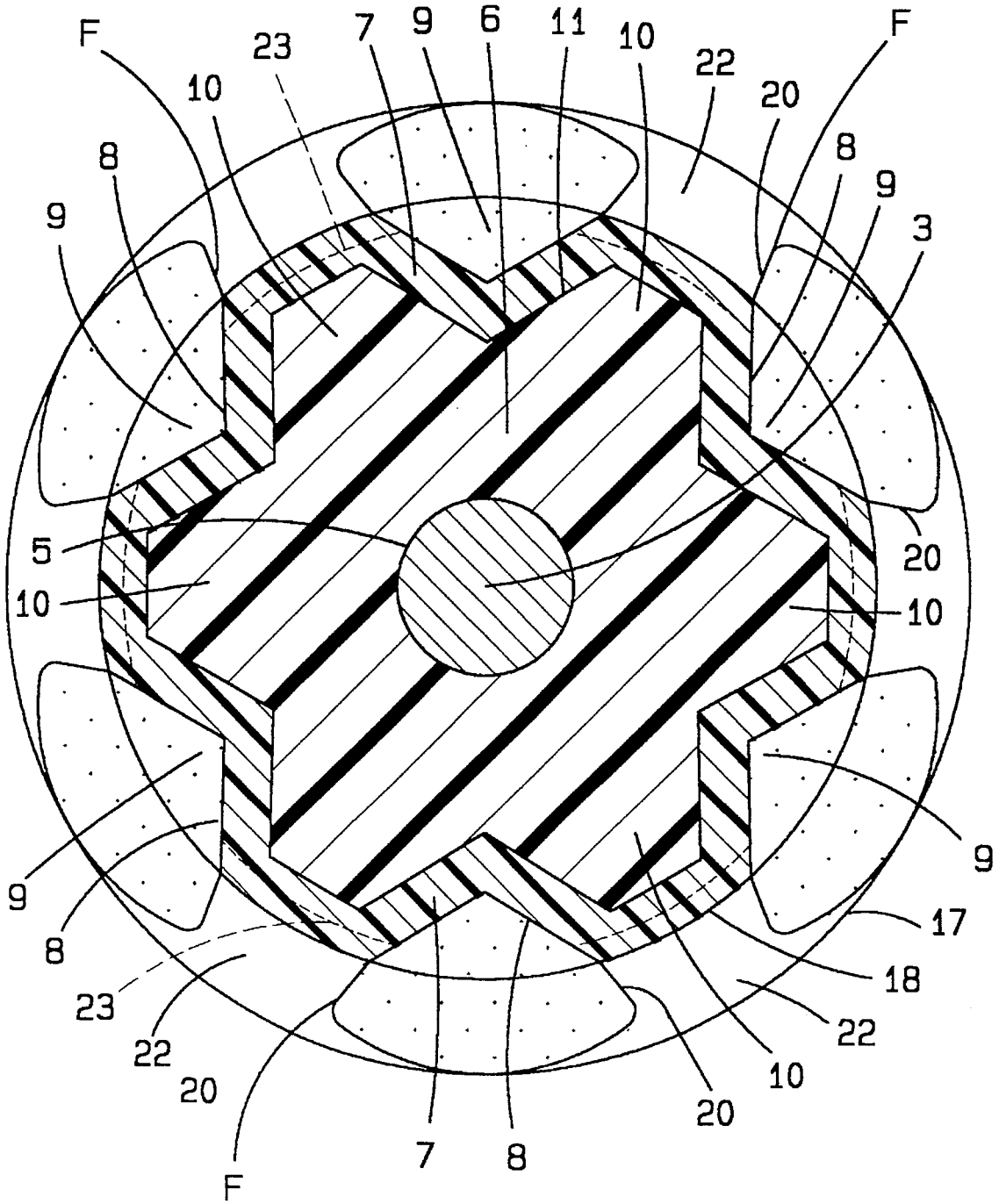
FIG. 12 shows this variant in a showing similar to FIG. 10.

The grooves 23 forming the ribs 24 are held free upon the application of the cover 7 by filling pieces 25 pointing into the mold cavity N which are taken into account on an injection mold Sp. The filling pieces can terminate in the cross section of the cover 7, as can be noted from FIG. 11, or else extend up to the cover surface 11 of the center part 6 which forms the heart of the handle H. In this way, the softer plastic which forms the fillings 9 and ribs 24 would have an anchoring directly at the two other zones, namely on the cover 7 and on the center part 6.

Figure 7:
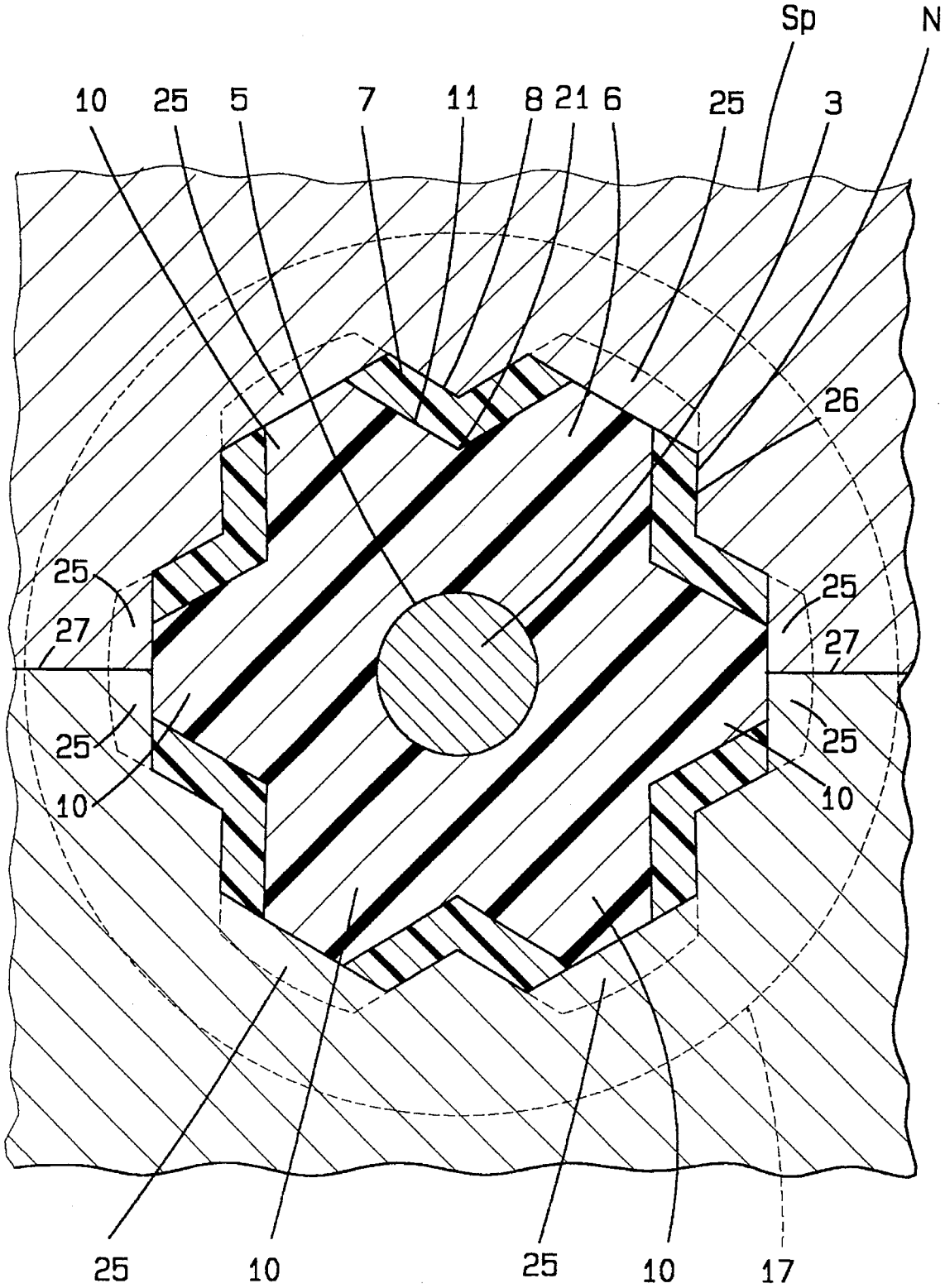
FIG. 7 is a section along the line VII—VII of FIG. 5, on a larger scale, showing the groove-forming filling pieces.

The version of the filling pieces 25 which extends, directed radially inward, up to the heads of the projections 10 of trapezoidal cross section can be noted, for instance, from FIG. 7. The filling pieces 25, as can be seen there, continue up into the filling space 26 of the injection mold Sp which forms the cover 7, namely to the bottom of the filling space.

In the parting joint 27 of the two halves of the injection mold Sp, the corresponding filling piece 25 is there, of course, formed proportionally by the halves of the mold.

The center part 6 consists of porously injected recycling material. This is of particular advantage insofar as the quality of the corresponding scrap material is not of eminent importance. It must be injectable and may have a mixed structure of even middle hardness. The structure, no matter how obtained, is namely stabilized by the cover 7 of plastic of harder nature which surrounds the center part 6 on all sides. On the other hand, a relatively soft filling of the pocket which is surrounded by the cover 7 can also be advantageous for attachment by insertion of screwdriver blades 7 having self-cutting fins 4.

Another advantage of such a porous construction consists in a frame structure which even elastically takes up higher loads, so that extreme deformations of the handle H do not lead to a detachment of the layers of plastic which are connected to each other. In addition, as further component, there is also the depth-wise engagement which varies in circumferential direction of the layers in each other. Turning loads acting on the handle H come always against flanks of blocking action in view of the aforementioned gear-shaped cross section of the center part 6 and the cover 7. The fillings 9 are compressed in the direction of the pockets which receive them.

A final advantage results from the porous structure which contains gaseous inclusions for useful floatability of the handle H, so that the screwdriver, etc., is not lost under such operating conditions. An open-pore or closed-pore structure may also be involved, in which connection, in the case of the open-pore structure, no water or the like can penetrate due to a suitable covering also of the end of the center part 6 facing the knife edge 1. This zone of the cover wall which closes off the entrance to the hollow space 5 up to the cover surface of the screwdriver blade 2 bears the reference numeral 28.

The profiling essentially copies the corrugation of the shank produced by the fillets.

Figure 13:
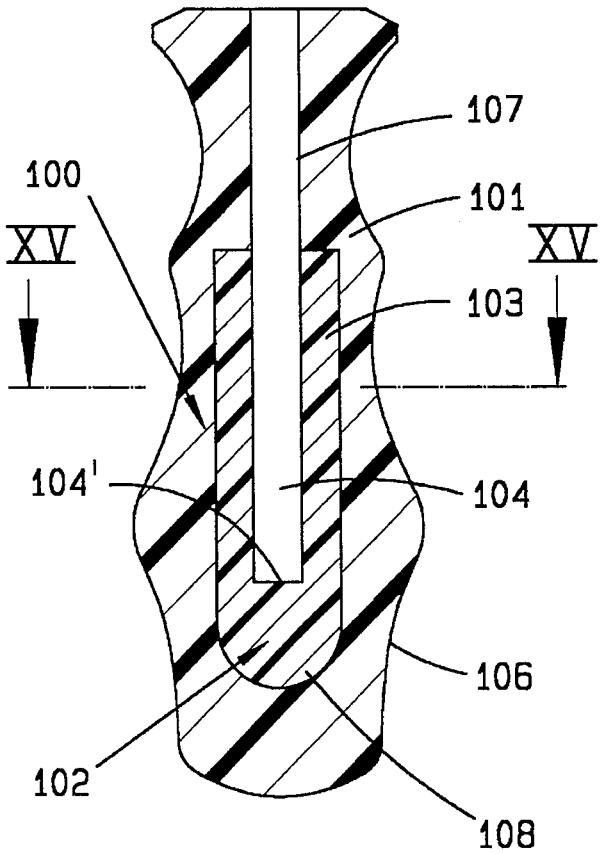
FIG. 13 shows a handle of a screwdriver of another embodiment.
Figure 14:
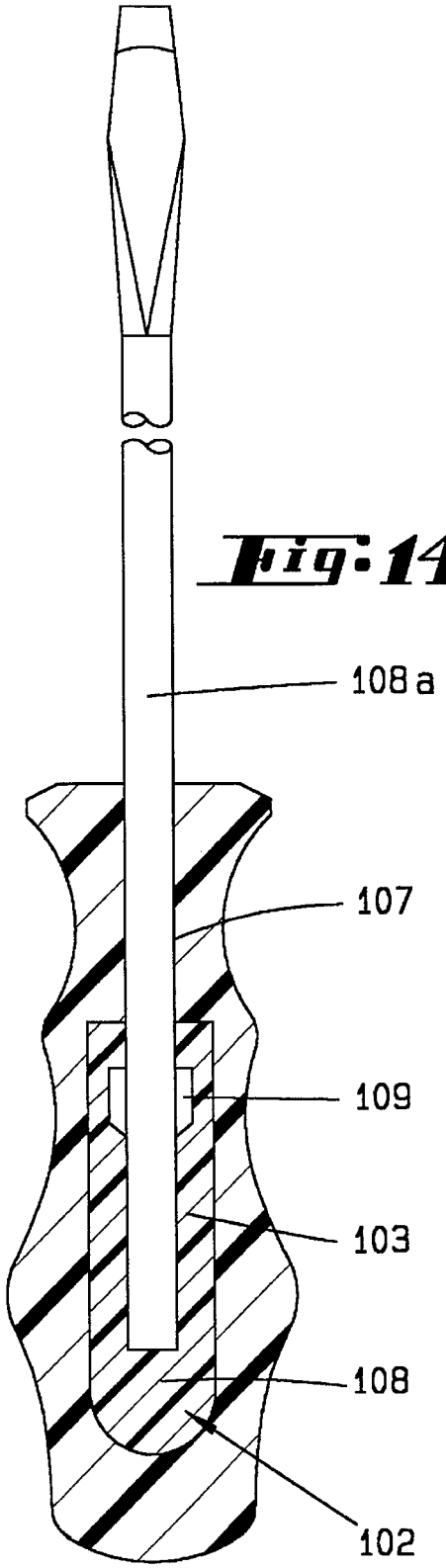
FIG. 14 shows the handle according FIG. 13, with blade inserted.
Figure 15:
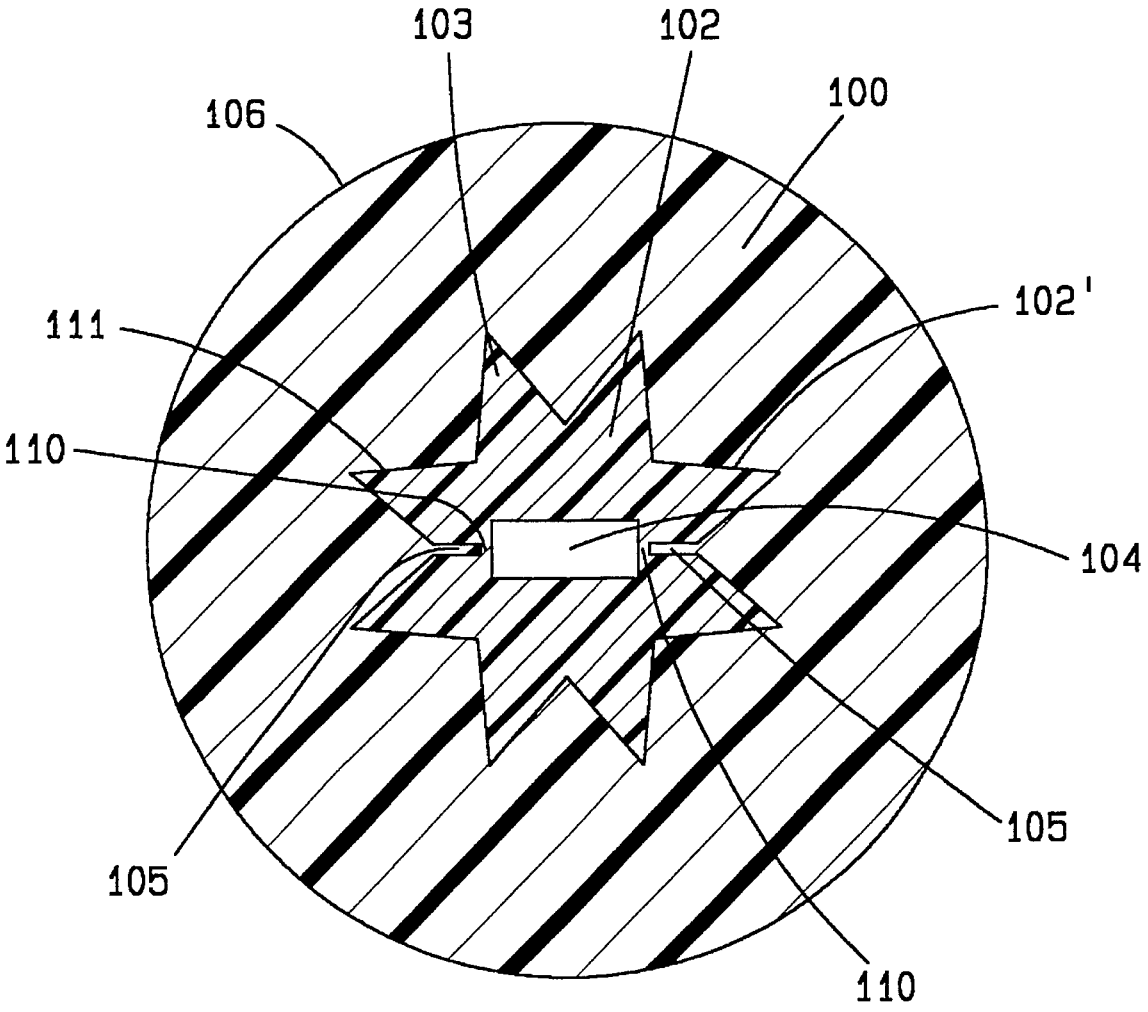
FIG. 15 shows a handle according to FIG. 13 in cross section along the line XV—XV.

FIG. 13 shows another embodiment of the invention. In that case, the handle 100 has a hard center part 102 which has a central hollow space 104 which is aligned with a central hollow space 107. The center part 102 has a dome 108 into which the hollow space 104 adjoining the hollow space 107 extends. The center part 102 of this handle is made of a hard plastic material, particularly polycarbon. This hard plastic part 102 has a profiled cover surface 102' which is of star-shaped profile (FIG. 15). The stars 103 extend radially into a region 101 of a softer, elastic plastic material. The outer contour of the handle 100 is formed by the zone 101 of softer plastic. This zone forms the surface 106 of the handle. In the embodiment, the handle has a cylindrical outer cross section. The star-shaped cover cross section of the inner center part forms intended place of points of breakage 110. These intended points of breakage are formed as webs of material (also labeled with reference numeral 110) substantially by two center-part halves which are developed with mirror symmetry which are attached to each other by the webs of material 110. By this attachment of the two halves by means of webs of material 110, slits 105 are formed which are filled with softer material. In the embodiment shown, the hollow space 104 has a rectangular cross section.

If now, in this embodiment, a blade 108 with screwdriver head is for instance pushed into the hollow space 107, the fins 109 of the blade 108 should be so oriented that they align with the points of intended breakage 110. Upon the insertion, which is effected by the application of force in axial direction onto the blade, the fins 109 of the blade 108 thus break the webs 110 of the place of intended breakage. The two opposite parts of the center part 102 which are thereby produced are in this way pressed apart from each other against the elastic restoring forces of the zone 101 of elastic material. As soon as the fin region has passed through a region of the hollow space, the slit is closed as a result of the elastic application pressure which presses against the two divided hard center parts, so that the blade is secured against being pulled out. The blade 108 is driven into the hollow space 104 until its end surface comes against the rear end surface 104' of the hollow space 104. The end of the blade thus lies in the dome 108 and can be acted on by axial forces.

Figure 16:
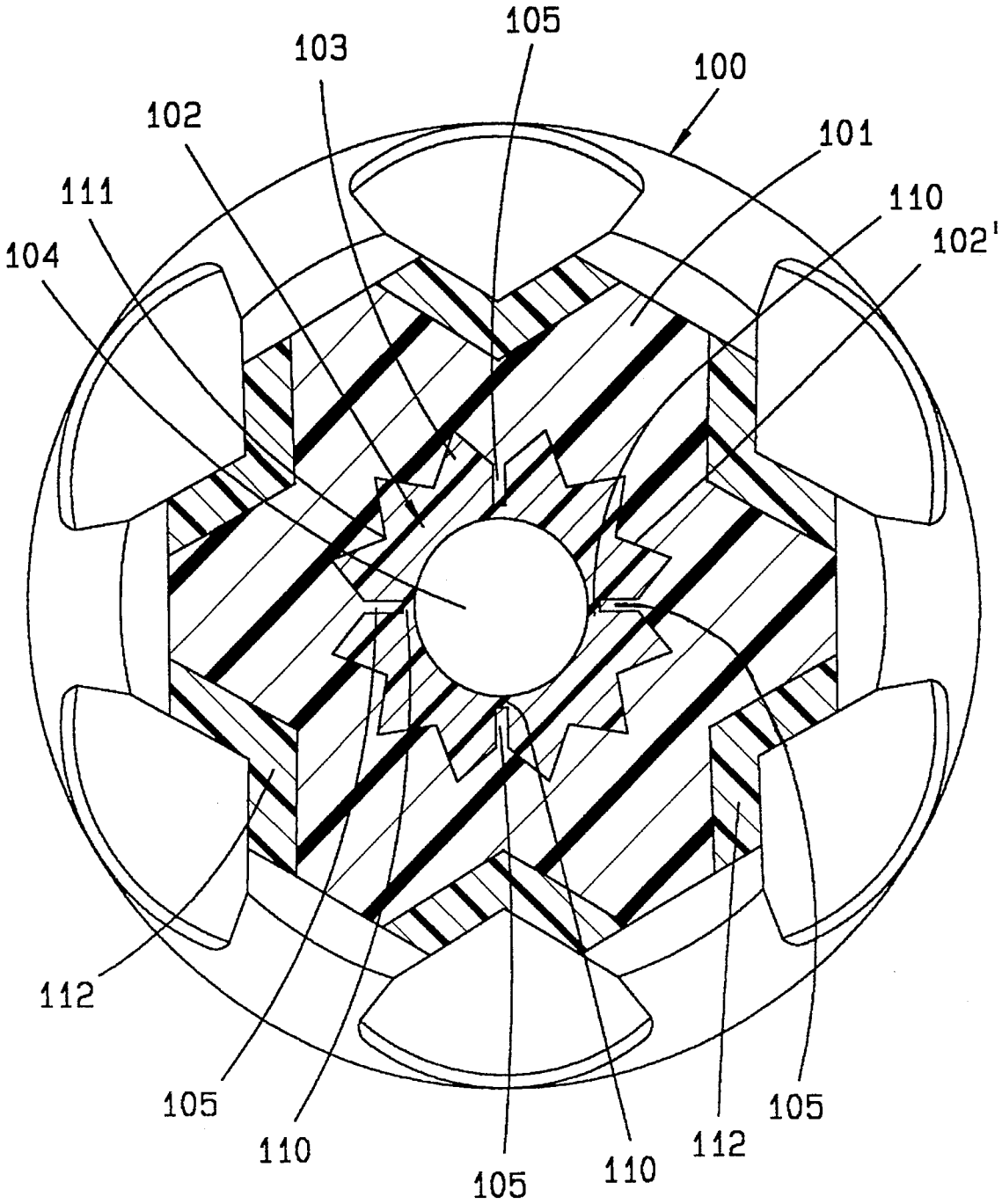
FIG. 16 is a cross section through another embodiment of the invention.

The cross-sectional area of the hollow space 104 which, as can be noted in particular in FIG. 16, may also have a round cross section, is preferably less than the cross-sectional area of the blade to be inserted into the hollow space 104. In this way, assurance is had that after the breaking of the points of intended breakage which takes place upon the pushing through of the fins 109, radial loading on the blade is always assured.

Figure 9:
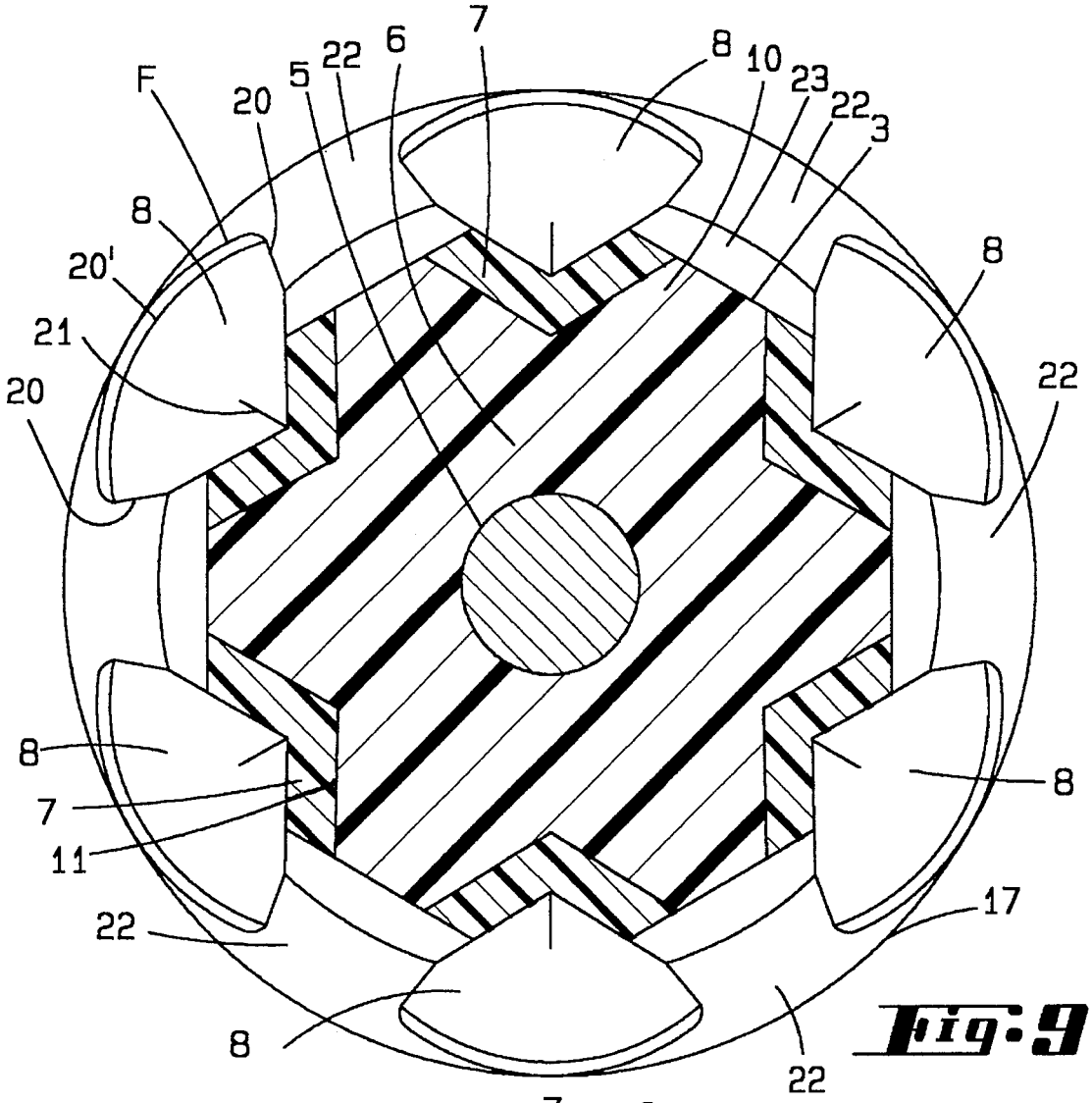
FIG. 9 is a section along the line IX—IX of FIG. 8, on a larger scale.
Figure 10:
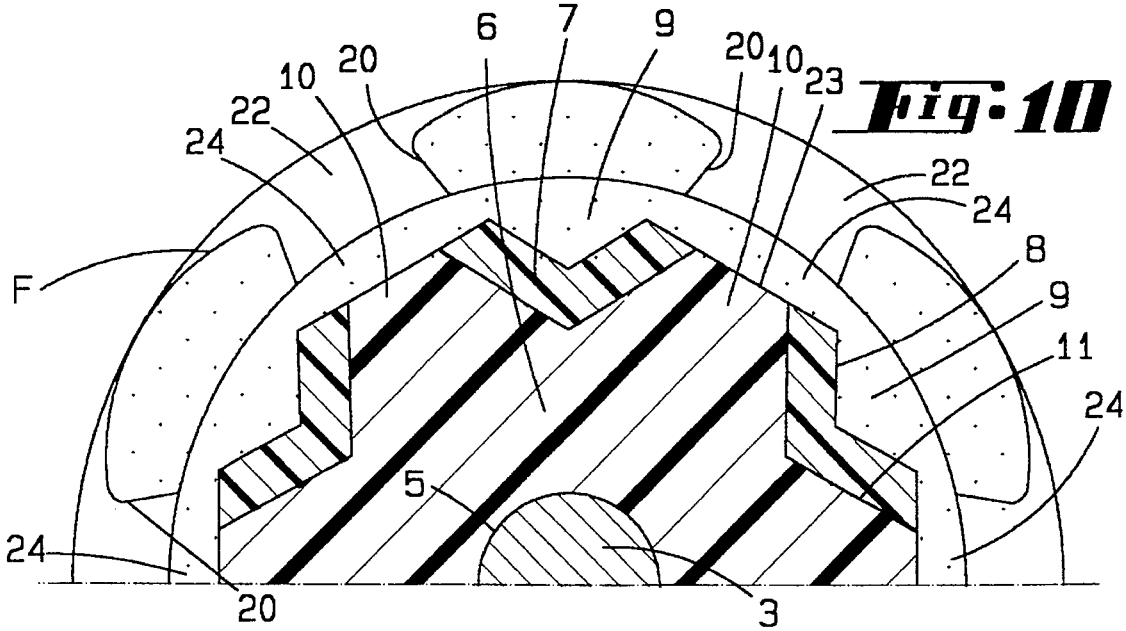
FIG. 10 is an enlarged cross section corresponding to FIG. 9 after the filling of the depressions (shown here only as a half section)

In the embodiment shown in FIG. 16, the zone or cover 101 has a sleeve 112 of a hard material injected around it. This embodiment corresponds essentially to FIG. 9 so that reference is had here to the description given of that embodiment (FIG. 9). Differing from the embodiment of FIG. 9, the embodiment of FIG. 16 has a central hard center 102, with a total of four points of intended breakage 110, which, in the same way as the embodiment of FIG. 15, are also formed by webs which leave slits 105 into which softer material is in its turn injected.

This embodiment, in which a central zone of elastic material is provided which is surrounded by a hard cover, has the advantage that the elastic forces which act on the center part result from a compressibility of the elastic zone 101. The hard center part 102 which is developed with a star-shaped profile is thus, after the destruction of the places of intended breakage upon the driving in of the tang, acted on in radial direction by the restoring force of the compressible plastic material of zone 101.

With regard to the outer contour and outer structure of this handle, reference is had to the description of FIG. 9, thus in particular, the webs and the depression as well as the fillings with softer material on the surface of the screwdriver have been described.

The split development of the hard cross-sectionally profiled center part has the advantage, in particular, that the fin 109 or the like of the tang 108 serves not only for the transmission of torque but also as barb for the axial fastening of the tang in the handle. Due to its profiling, the hard center part forms an enlargement of the torque transmission surface.

We claim:

1. A plastic injection-molded handle for tools, particularly screwdrivers, comprising zones of plastic of different hardness comprising a harder plastic which is harder than a softer plastic, the harder plastic being non-deformable under forces which occur as a result of an actuating load, while the softer plastic permits slight elastic deformations, and a centrally located receiving hollow space for a tang of a tool blade, and wherein the central hollow space is located in a center part having a profiled cover surface around which a cover is injected, the cover being made of the harder plastic and having depressions, the depressions resulting from profiling of the cover surface, and said depressions being filled with a plastic which is softer than the harder plastic up to an approximately circular cross-sectional shape.

2. A handle according to claim 1, wherein the cross section of the center part is profiled approximately in gear or star shape.

3. A handle according claim 1, wherein said center part is made of the softer plastic.

4. A handle according to claim 3, wherein the zones of plastic of different hardness pass into each other, and said cover has an approximately constant wall thickness of the harder plastic.

5. A handle according to claim 1, wherein individual fields of the filled depressions, which fields lie one behind the other in circumferential direction, are connected by a rib of said plastic which is softer than the harder plastic which extends in circumferential direction and fills a groove in the cover.

6. A handle according to claim 5, wherein the groove extends in depth up to the center part.

7. A handle according to claim 1, wherein the center part is made of porously injected recycling material.

8. A plastic injection-molded handle for tools, particularly screwdrivers, comprising zones of plastic of different hardness comprising a harder plastic which is harder than a softer plastic, the harder plastic being non-deformable under forces which occur as a result of an actuating load, while the softer plastic permits slight elastic deformations, and a centrally located receiving hollow space for a tang of a tool blade, and wherein the central hollow space is located in a center part having a profiled cover surface around which a cover of the softer plastic is injected, depressions resulting from profiling of the cover surface of the center part are filled with the softer plastic of the cover up to an approximately circular cross-sectional shape, and the center part forms at least one radial point of intended breakage.

9. A handle according to claim 8, wherein the center part is made of the harder plastic.

10. A handle according to claim 8, wherein the center part forms a dome which extends over an end of the hollow space.

11. A handle according to claim 8, wherein the points of intended breakage are formed as webs of material arranged between said cover surface and an inner surface of the hollow space.

12. A handle according to claim 8, wherein the cover, is made of an elastic, particularly compressible, plastic, and said cover has a sleeve of plastic material injected therearound, said plastic material is harder than said softer plastic.

13. A handle according to claim 12, wherein said elastic plastic is PE.

14. A handle according to claim 12, wherein said elastic plastic is PP.

15. A handle according to claim 12, wherein said elastic plastic is a plastic foam.

16. A handle according to claim 8, wherein the cross section of the center part is profiled approximately in gear or star shape.

17. A handle according to claim 8, wherein the center part is made of porously injected recycling material.

18. A handle according to claim 8, wherein the center part forms two radial points of intended breakage arranged in uniform circumferential distribution.

19. A handle according to claim 8, wherein the center part forms four radial points of intended breakage arranged in uniform circumferential distribution.

20. A handle according to claim 8, wherein the harder plastic is polycarbon.

* * * * *